US006926606B2

(12) United States Patent
Onuki et al.

(10) Patent No.: US 6,926,606 B2
(45) Date of Patent: Aug. 9, 2005

(54) GAMING MACHINE

(75) Inventors: Yoshikazu Onuki, Tokyo (JP); Kaoru Watanabe, Tokyo (JP); Takao Sasazaki, Tokyo (JP)

(73) Assignee: Konami Corporation, Tokyo (JP)

( * ) Notice: Subject to any disclaimer, the term of this patent is extended or adjusted under 35 U.S.C. 154(b) by 0 days.

(21) Appl. No.: 10/401,542

(22) Filed: Mar. 31, 2003

(65) Prior Publication Data

US 2003/0195035 A1 Oct. 16, 2003

(30) Foreign Application Priority Data

Apr. 11, 2002 (JP) ..... P2002-109606

(51) Int. Cl.[7] ..... G07F 17/34

(52) U.S. Cl. ..... 463/20; 463/31; 463/34; 273/143 R

(58) Field of Search ..... 463/20, 12, 13, 463/31, 34; 273/143 R, 138

(56) References Cited

U.S. PATENT DOCUMENTS 6,517,433 B2 * 2/2003 Loose et al. ..... 463/20

FOREIGN PATENT DOCUMENTS

| | | | | |
|---|---|---|---|---|
| JP | 2001259172 A | * | 9/2001 | ..... A63F/7/02 |
| JP | 2002078844 A | * | 3/2002 | ..... A63F/5/04 |
| JP | 2002113150 A | * | 4/2002 | ..... A63F/5/04 |
| JP | 2002301224 A | * | 10/2002 | ..... A63F/7/02 |

* cited by examiner

*Primary Examiner*—Benjamin Layno
(74) *Attorney, Agent, or Firm*—Sughrue Mion, PLLC

(57) ABSTRACT

A gaming machine includes at least one reel to be rotated. A reel belt is attached onto an outer circumferential face of the reel. The reel belt includes a half mirror layer, and a print layer on which at least one symbol is printed. The print layer is placed behind the half mirror layer when viewed from a front face of the gaming machine.

10 Claims, 8 Drawing Sheets

GAMING MACHINE

BACKGROUND OF THE INVENTION

The invention relates to a gaming machine having reels, such as a slot machine or a skilled-stop type gaming machine.

Gaming machines having reels, such as slot machines and skilled-stop gaming machines, are classified into reel-type gaming machines having mechanical spinning reels, and video-type gaming machines for variably displaying symbols on a display. On the basis of image data stored in a ROM or the like, the video-type gaming machine displays symbols on the display. Hence, the size and color of a symbol to be displayed can be changed freely. Accordingly, the video-type gaming machine provides a variety of presentation effects. Further, moving animations can also be displayed on the video-type gaming machine.

The reel-type gaming machine usually comprises three reels, three reel stop buttons associated with the respective reels, and a start lever to be used for starting a game. When a player actuates the start lever, all reels start spinning simultaneously. When the player presses the respective reel stop buttons, the corresponding reels come to a halt. When specific symbols have come to a halt along a valid pay line, a winning combination is established, whereby a win arises. As a result, the player can acquire tokens equal in number to the thus-established winning combination.

In some recent reel gaming machines, lamps are disposed at the inside of the reels, thereby illuminating the back faces of symbols. The reel gaming machine of this type has an advantage of the ability to make the symbols conspicuous.

However, in the related-art reel gaming machine, symbols are fixed on the respective reels, and the symbols are rotationally displayed in a cyclic manner. The reel gaming machine cannot change the color of the symbol or the like, which would be possible for the video-type gaming machine. Hence, when the reel gaming machine is compared with a video gaming machine, the sizes and colors of symbols to be displayed cannot be changed freely. Eventually, the game tends to become monotonous.

A player who is skilled in operation of reel stop buttons can perform so-called pinpoint stopping action, thereby acquiring a larger amount of tokens than those acquired by an unaccustomed player. A difference in skill between players leads to a problem of a wide margin arising in the number of tokens which can be acquired by the players.

SUMMARY OF THE INVENTION

It is therefore an object of the invention to provide a reel-type gaming machine which imparts a pleasant sense of surprise to a game by broadening the scope of symbols to be displayed and which prevents reflection of a difference in skill between players on the number of tokens acquired.

In order to achieve the above object, according to the invention, there is provided a gaming machine, comprising:

at least one reel, to be rotated; and a reel belt, attached onto an outer circumferential face of the reel, the reel belt comprising:

a half mirror layer; and a first print layer, on which at least one first symbol is printed, placed behind the half mirror layer when viewed from a front face of the gaming machine.

Here, the half mirror is a mirror which permits a slight amount of light to pass through by reducing the quantity of reflecting material to be formed on a flat-shaped transparent substrate. Mirror is usually formed by evaporating metal, such as silver or aluminum, on a transparent substrate in a vacuum. The evaporated metal adheres to portions of the surface of the transparent substrate as a result of reduction in the amount of evaporated metal. Accordingly, light can pass through areas of the substrate between the thus-evaporated areas. As a result, half of light is reflected from the mirror, and the other half of light is visible from the back of the mirror.

Therefore, external light (including light used for illuminating the reels provided in a housing) entering the gaming machine from the player's side is usually intense, and hence the half mirror looks like a mirror surface (i.e., silver color). Conversely, when the intensity of the light radiated onto the back of the half mirror is increased, the player can view the light having passed through the half mirror and a background. Thus, a change can be made to the shapes and colors of the symbol and those of the background, which are to be expressed on the reel, by cooperative action of the half mirror and illumination of the back light.

The first print layer can be formed by various printing techniques, such as silk printing or offset printing. Different colors can be printed in a superimposed manner by utilization of silk printing. Hence, silk printing yields an advantage in a case where the range of expression is to be broadened.

Preferably, the half mirror layer is provided so as to overlap at least a part of the first symbol.

In such a configuration, a variety of expressions can be provided by combining symbols and the background provided on the first print layer and the half mirror layer with activation/deactivation of back light.

Preferably, the reel belt further comprises a second print layer, on which at least one second symbol is printed, placed before the half mirror layer when viewed from the front face of the gaming machine.

In such a configuration, a variety of expressions can be provided by combination of symbols and the background printed on the print layers and the half mirror layer by activation/deactivation of back light.

Here, it is preferable that the second print layer includes a portion transparent with respect to visible light.

In such a configuration, a quite natural combination of symbols can be formed by the symbols printed on the print layers.

Further, it is preferable that the half mirror layer is provided so as to overlap at least a part of at least one of the first symbol and the second symbol.

Further, it is preferable that: a plurality of first regions are arranged on the first print layer in a rotating direction of the reel such that the first symbol is printed in each of the first regions; a plurality of second regions are arranged on the second print layer in the rotating direction of the reel such that the second symbol is printed in each of the second regions; and each of the first regions is associated with at least one of second regions.

In such a configuration, the presentation of the symbol perceived by the player can be enhanced.

In such a configuration, a variety of expressions can be provided by combining symbols provided on the print layers and the geometry of the half mirror layer.

Preferably, the half mirror layer is laminated on the first print layer.

So long as the half mirror layer is not brought into contact with the base film layer, a range in which the transparency of the half mirror can be controlled can be broadened.

Preferably, the half mirror layer is laminated on a film layer having transparency with respect to visible light.

In such a configuration, a half mirror can be prepared in another process, and hence the time required for manufacturing processes can be shortened.

Here, it is preferable that the film layer is placed in front of the half mirror layer when viewed from the front face of the gaming machine.

In such a configuration, since the half mirror layer is not exposed to the outside, the half mirror layer is easy to handle and less susceptible to time-varying changes.

Preferably, the gaming machine further comprises a light source placed behind the reel belt when viewed from the front face of the gaming machine, for emitting visible light toward the front face of the gaming machine.

In such a configuration, the presentation of the symbol perceived by the player can be selected by controlling activation or deactivation of the light source.

The light source may be disposed in front of the reel band, as well as behind the reel band. In such a construction, more various display can be effected by controlling activation and deactivation of the light sources disposed in front of and behind the reel band.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the invention will be described hereinbelow by reference to the accompanying drawings. Here, an explanation is given of a case where the invention is applied to a slot machine.

Figure 1:
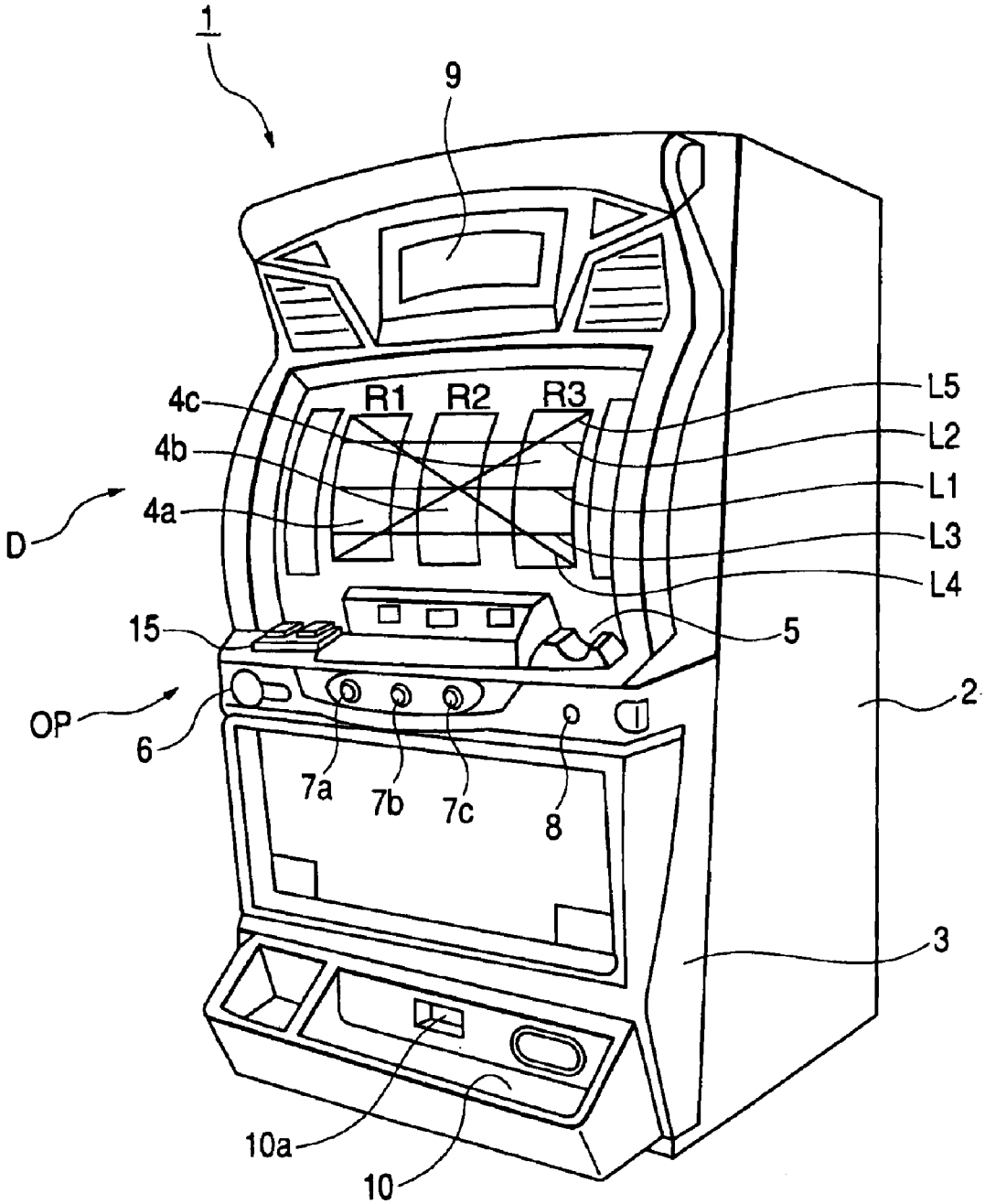
FIG. 1 is a perspective view showing a slot machine.

FIG. 1 is a perspective view showing the external appearance of a slot machine 1 according to a first embodiment of the invention. A housing of the slot machine 1 has a main unit 2, and a front door 3 attached to the front of the main unit 2. A liquid-crystal display device 9 for providing a player with predetermined information is arranged at an upper portion of the front door 3. A panel display section D disposed at a middle portion of the front door 3 has three horizontally-oriented rectangular display windows 4*a*, 4*b*, and 4*c*. Three horizontal pay lines L1 through L3 and two sloped pay lines L4 and L5 are provided across the display windows 4*a*, 4*b*, and 4*c*. Three reels, on whose outer peripheral faces a plurality of kinds of symbols are drawn; that is, a left reel R1, a center reel R2, and a right reel R3, are rotatably disposed at the inside of the panel display section D. The display windows 4*a*, 4*b*, and 4*c* are formed from transparent material; e.g., acrylic resin. Accordingly, the player can observe symbols appearing on the respective left, center, and right reels R1, R2, and R3 through the display windows 4*a*, 4*b*, and 4*c*.

Figure 2:
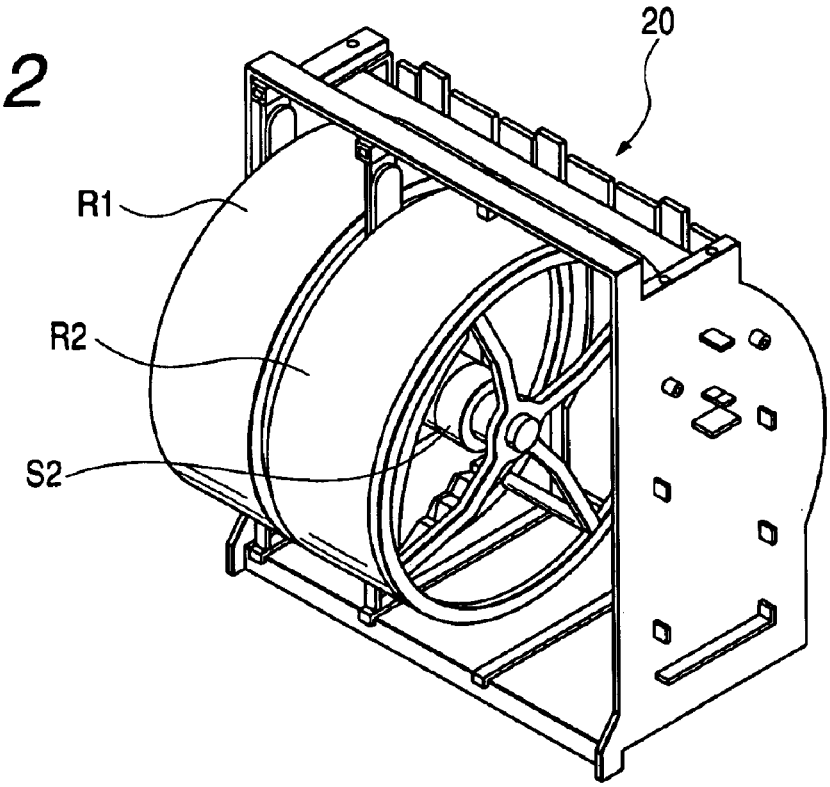
FIG. 2 is a perspective view showing a reel housing.

FIG. 2 shows a reel housing 20 from which a right reel R3 has been removed and which is provided with only a left reel R1 and a center reel R2. The reel housing 20 is provided at a position away from the display windows 4*a*, 4*b*, and 4*c* shown in FIG. 1; that is, a position located slightly higher than the inner center of the main body 2. The three reels R1, R2, and R3 are arranged at positions in the reel housing 20 where the reels share a common axis. The reels R1, R2, and R3 are rotated and stopped by stepping motors attached to the respective reels (FIG. 2 shows only a center reel stepping motor S2 for driving the center reel R2).

Figure 3:
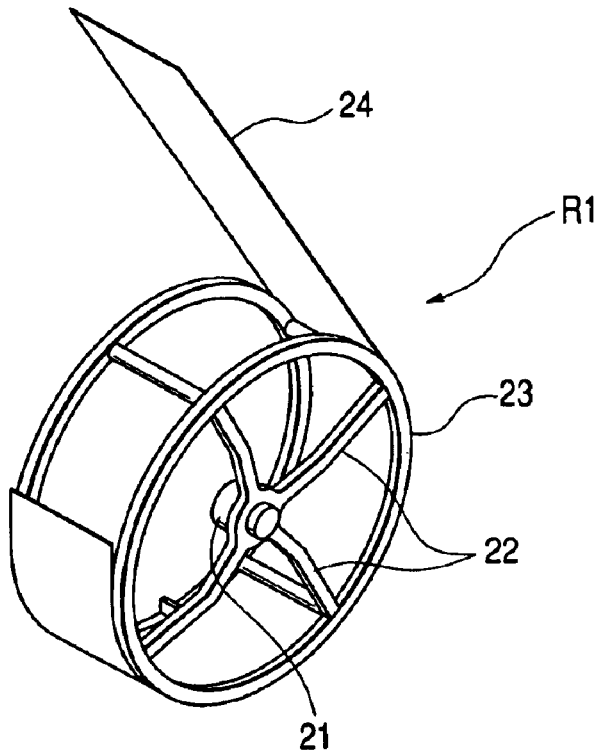
FIG. 3 is a perspective view showing the structure of a reel.

FIG. 3 is a view showing the structure of each reel. Here, the left reel R1 is described as an example. The left reel R1 comprises a hub section 21 for receiving drive force originating from a reel drive stepping motor; four spoke sections 22 radially spread from the hub section 21 to the outside; a cylindrical section 23 which is attached to the extremities of the spoke sections 22 and assumes a cylindrical shape; and a reel belt 24 which covers an outer peripheral face of the cylindrical section 23. The reel belt 24 is fixed to the outer peripheral face of the cylindrical section 23 by utilization of an adhesive or a double-sided tape. Details of the reel belt 24 will be described later.

Figure 4A:
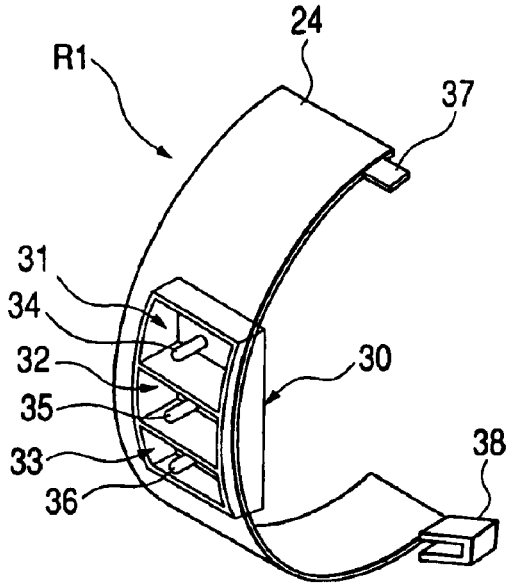
FIG. 4A is a perspective view showing a reel band and an illuminator.
Figure 4B:
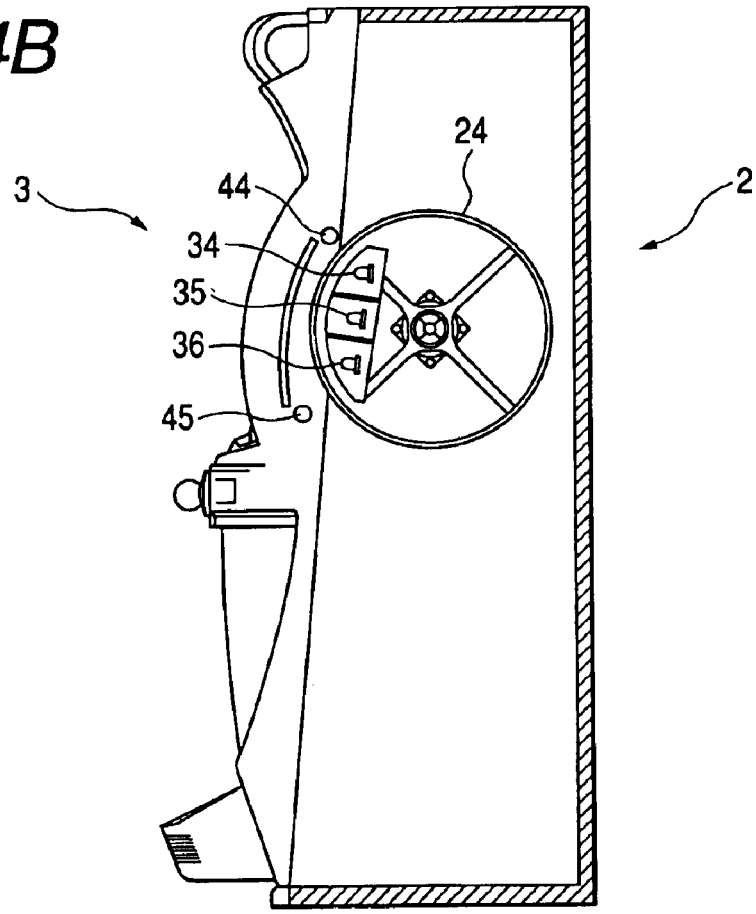
FIG. 4B is a side section view showing the illuminator disposed inside the slot machine.

FIG. 4A is a view showing the reel belt 24 and an illuminator. A left reel illuminator 30 is disposed at a position corresponding to the display window 4*a* of the left reel R1. The left reel illuminator 30 has an upper shade 31, a center shade 32, and a lower shade 33, which are partitioned from each other by walls. The upper shade 31 has a white cold-cathode tube 34; the center shade 32 has a white cold-cathode tube 35; and the lower shade 33 has a white cold-cathode tube 36, wherein all the white cold-cathode tubes illuminate white light. As shown in FIG. 4B, when viewed from the player's position, white cold-cathode tubes 44 and 45 which illuminate white are provided at positions close to the reel belt 24.

Preferably, the cold-cathode tubes 44 and 45 are provided at upper and lower positions with respect to the display windows 4*a* to 4*c*, wherein the positions are not directly visible to the player. The light source is not limited to cold-cathode tubes. For example, a lamp or a light-emitting diode (LED) can be used in place of the cold-cathode tubes 34, 35, and 36, as required. A white LED or an LED which illuminates three colors (Red, Green, Blue) simultaneously may also be employed as the light-emitting diode. Fluorescent light or a lamp may be used in lieu of the white cold-cathode tubes 44, 45 provided in front of the reel belt, as required.

Display of a variety of symbols can be performed by controlling activation/deactivation of a cold tube or the like, which will also be described in detail later. A shading piece 37 is provided on a part of the left reel R1 so as to project from the main body of the reel. When the left reel R1 spins, the shading piece 37 runs across a photocoupler 38. As a result, positional information about symbols is reset every time the reel spins once, thereby preventing occurrence of a deviation in the positional information, which would otherwise be caused in association with spinning of the reel. The structure of the center reel R2, a peripheral configuration thereof, the structure the right reel R3, and a peripheral configuration thereof are the same as the structure of the left reel R1 and a peripheral configuration thereof, which have been described by reference to FIGS. 3 and 4.

Figure 5A:
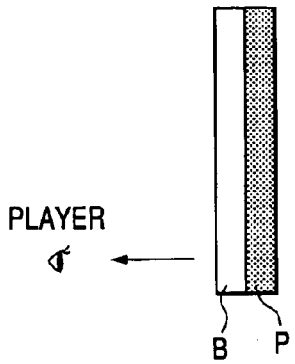
FIG. 5A is a schematic view showing the layered structure of a related-art reel band.

FIGS. 5A to 5H are views schematically showing a cross section of the reel belt 24 when taken along a plane parallel to the radial direction of the reel. FIG. 5A shows a cross section of a related-art reel belt; and FIGS. 5B to 5H show cross-section of the reel belt according to the embodiments of the invention. For the sake of convenience, throughout the drawings, the thickness of each layer is represented as being uniform. In reality, a base film layer B has a thickness of 200 $\mu$m or thereabouts, and a half mirror layer HM assumes a thickness of 6 $\mu$m or thereabouts. Throughout FIGS. 5A to 5H, the left side of the drawing means the outside of the reel, whereas the right side of the drawing means the inside of the reel. Accordingly, under the assumption that those portions of the reel belts are placed at the positions of the display windows 4*a*, 4*b*, and 4*c*, the left side in the drawing faces the player, and the right side in the drawing faces the illuminator 30 or the like.

The base film layer B usually employs transparent resin, such as acrylic resin, polycarbonate, polystyrene, polypropylene, or PET (polyethylene terephthalate), or translucent resin formed by addition of pigments or dyes to the transparent resin. A print layer P is formed on the base film layer B through offset printing or silk printing. The half mirror layer HM is formed by forming an evaporated metal film, such as aluminum, on the base film B or through transfer. After formation of the half mirror layer HM, the print layer P may be formed on the half mirror layer HM. Further, after formation of the print layer P on the base film B, the half mirror layer HM may be formed on the print layer P.

According to the layered structure of the related-art reel belt shown in FIG. 5A, the base film layer B is disposed so as to face the player, and the print layer P is disposed at a position close to the reel. A symbol and a background thereof printed on the print layer P are made color-transparent so as to enable a portion of back light to pass through. Here, the term "color-transparent" means a characteristic of transmission of light of wavelengths in a predetermined wavelength region. Wavelengths in a predetermined region primarily refer to wavelength regions of visible light. Colors of a symbol printed on the print layer pass through.

By such a structure, when the white cold-cathode light of the illuminator is not illuminated, external light passes through the transparent/translucent base film B and reaches the symbol printed on the print layer P and is reflected thereby. The thus-reflected light again passes through the base film B and reaches the player, whereby the player can ascertain the symbol. Once the white cold-cathode tube of the illuminator has been illuminated, the light originating from the white cold-cathode tube reaches the player while passing through the symbol printed on the print layer P and the base film layer B. Since the brightness of the illuminator is superior to the brightness of external light, the symbol provided on the front surface side of the illuminator is ascertained by the player so as to be more conspicuous than the other areas.

In any event, the symbol ascertained by the player is a symbol printed on the print layer P. An effect of activation/deactivation of the white cold-cathode tube remains at a level such that the symbol located on the front surface of the illuminator is made conspicuous. Accordingly, a symbol cannot be shown while the color or shape thereof changes.

A first embodiment of the invention will be described with reference to FIGS. 5B to 5D.

Figure 5B:
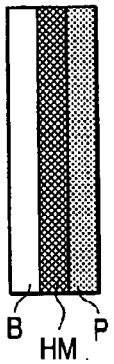
FIGS. 5B to 5D are schematic views showing the layered structures of a reel band according to a first embodiment of the invention.
Figure 5C:
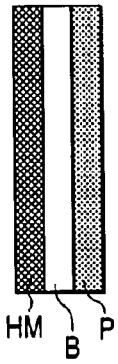
Figure 5D:
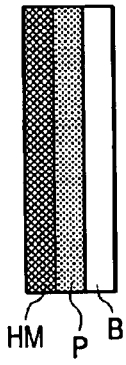

According to the structure shown in FIG. 5B, the base film layer B, the half mirror layer HM, and the print layer P are arranged in this order from the player. According to the structure shown in FIG. 5C, the half mirror layer HM, the base film layer B, and the print layer P are arranged in this sequence from the player. According to the structure shown in FIG. 5D, the half mirror layer HM, the print layer P, and the base film layer B are arranged in this sequence from the player.

In all of these layer structures, the half mirror layer HM is disposed in front of the print layer P when viewed from the player. Accordingly, when the white cold-cathode tube remains inactive, the player views external light reflected from the half mirror layer HM, and hence the half mirror looks silver. Through areas of the reel belt where the half mirror HM is not formed, the symbol printed on the print layer P can be viewed directly. Therefore, when the half mirror layer HM is formed over the entire surface of the reel belt, the player cannot see any symbols provided on the print layer P at all. If the half mirror layer HM is partially formed in the reel band, the player can partially view the silver portions of the half mirror layer HM and the symbol drawn on the print layer P.

When the white cold-cathode tube remains active, the light originating from the white cold-cathode tube passes through the half mirror layer HM via the print layer P and reaches the player. Accordingly, the player can perceive all the symbols printed on the print layer P. In the structure shown in FIG. 5D, since the half mirror layer HM is not brought into contact with the base film layer B, a range in which the transparency of the half mirror is controlled can be broadened.

A second embodiment of the invention will be described with reference to FIGS. 5E to 5G.

Figure 5E:
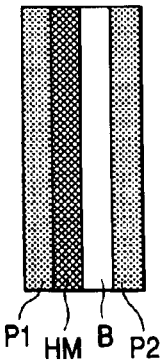
FIGS. 5E to 5G are schematic views showing the layered structures of a reel band according to a second embodiment of the invention.
Figure 5F:
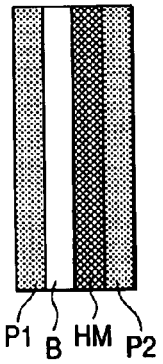
Figure 5G:
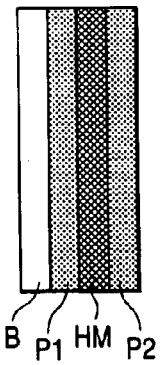

According to the structure shown in FIG. 5E, an auxiliary print layer P1, the half mirror layer HM, the base film layer B, a primary print layer P2 are arranged in this order from the player. According to the structure shown in FIG. 5F, the auxiliary print layer P1, the base film layer B, the half mirror layer HM, the primary print layer P2 are arranged in this sequence from the player. According to the structure shown in FIG. 5G, the base film layer B, the auxiliary print layer P1, the half mirror layer HM, the primary print layer P2 are arranged in this sequence from the player. In all of these layer structures shown in FIGS. 5E to 5G, the print layers P1, P2 are disposed at both the inside and the outside of the half mirror layer HM.

Accordingly, when the white cold-cathode tube remains inactive, the player simultaneously views the symbol located on the half mirror layer HM and the external light reflected from the areas of the half mirror layer HM (i.e., a silver color) where no symbol is provided. In contrast, when the white cold-cathode tube remains active, the light originating from the white cold-cathode tube reaches the player while passing through the primary print layer P2, the half mirror layer HM, and the auxiliary print layer P1 . Hence, the player can simultaneously perceive the symbol printed on the auxiliary print layer P1 and the symbol printed on the auxiliary print layer P2 in a superimposed manner.

Figure 5H:
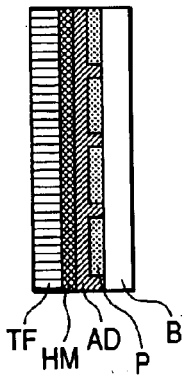
FIG. 5H is a schematic view showing the layered structure of a reel band according to a third embodiment of the invention.

A third embodiment of the invention will be described with reference to FIG. 5H. In this embodiment, the half mirror HM is formed on another translucent film TF and adhered to the print layer P provided on the base film layer B with an adhesive layer AD. Since the half mirror layer HM is not exposed to the outside, the half mirror layer is easy to handle and less susceptible to time-varying changes.

Display of symbols to be performed by the half mirror layer HM and the print layer P will be described more specifically. In the following explanations, a position close to the viewer corresponds to the lower side of the drawings, and a position distant from the viewer corresponds to the upper side of the drawings.

Figure 6:
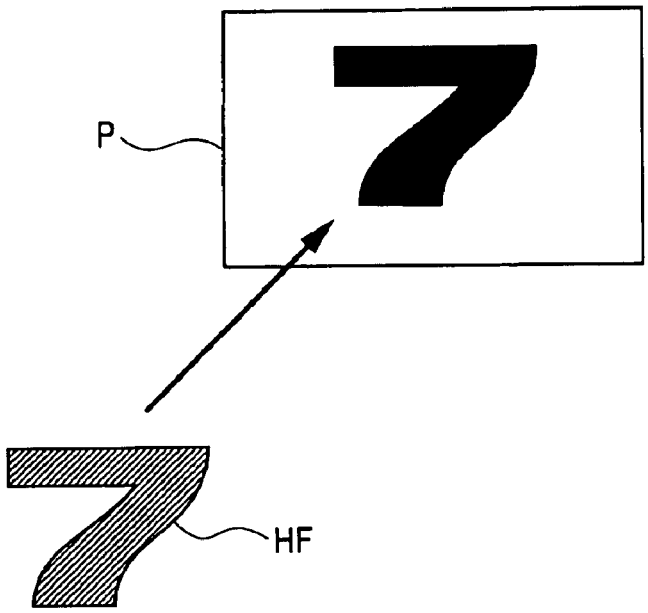
FIG. 6 is a schematic view showing the layered structure of a reel band according to a fourth embodiment of the invention.

FIG. 6 shows a fourth embodiment of the invention. In this embodiment, a symbol having a predetermined shape (e.g., RED 7) is printed on the print layer P. A half mirror layer HM which is identical with or slightly lager in geometry than the symbol of the print layer P is superposed onto the upper surface of the symbol of the print layer P. By such a configuration, when the white cold-cathode tube remains inactive, the player views the half mirror layer HM as the symbol and perceives a silver symbol (e.g., SILVER 7) of the predetermined shape. When the white cold-cathode tube remains active, the light originating from the white cold-cathode tube reaches the player while passing through the portion of the symbol of the color-transparent print layer P and the half mirror layer HM. Accordingly, the player perceives the symbol in the color (e.g., RED) provided on the print layer P. In this way, if the half mirror formed so as to assume the same shape as that of the symbol is provided on the symbol of the print layer P, the color of the symbol can be changed by activation/deactivation of the white cold-cathode tube.

Figure 7:
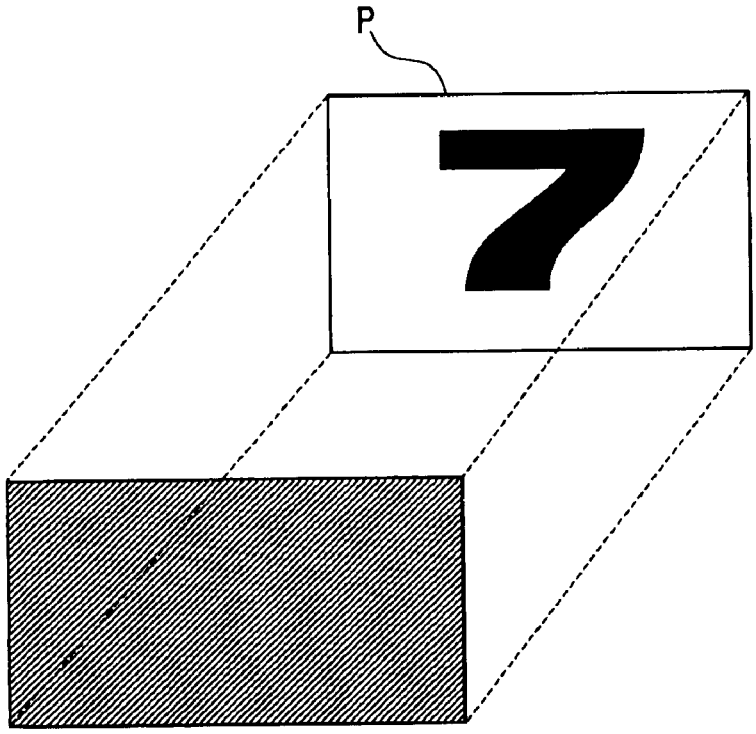
FIG. 7 is a schematic view showing the layered structure of a reel band according to a fifth embodiment of the invention.

FIG. 7 shows a fifth embodiment of the invention. In this embodiment, the entire front surface of the print layer P is covered with the half mirror layer HM. By such a configuration, when the white cold-cathode tube remains inactive, the player perceives only the silver plain surface and no symbols. In contrast, when the cold cathode tube is activated, the light originating from the cathode tube reaches the player while passing through the symbol on the color-transparent print layer P (e.g., RED 7) and the half mirror HM. Accordingly, the player can perceive the symbol in the color (e.g., RED) provided on the print layer P. In this way, if the half mirror layer HM is provided over the entire print layer P, the symbol of the print layer P can be made visible or invisible by activation/deactivation of the white cold-cathode tube.

Figure 8:
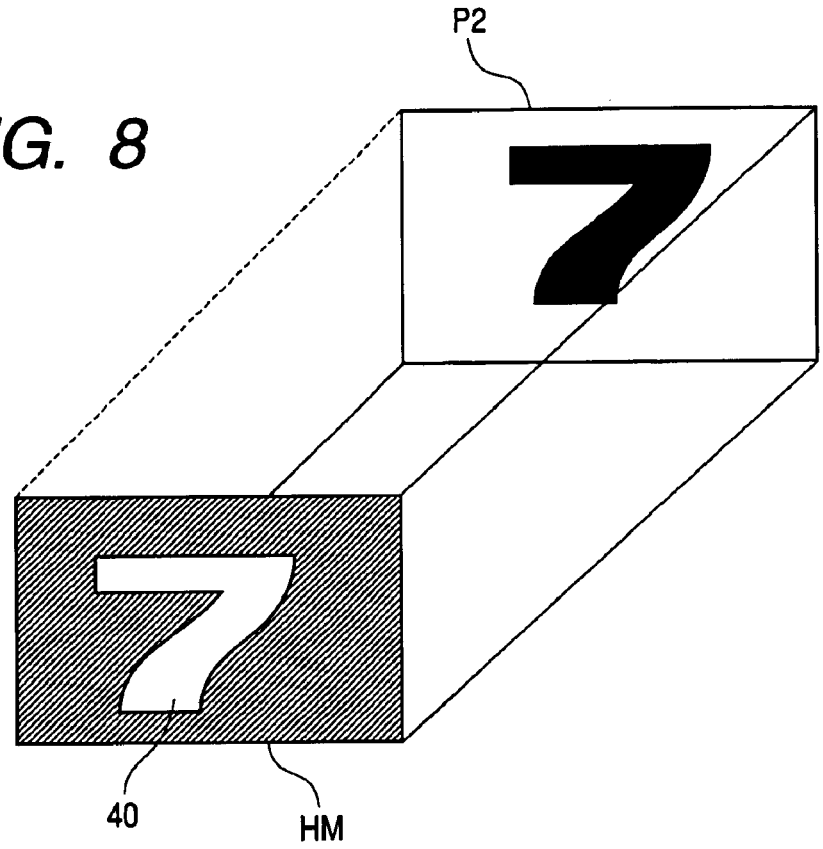
FIG. 8 is a schematic view showing the layered structure of a reel band according to a sixth embodiment of the invention.

FIG. 8 shows a sixth embodiment of the invention. In this embodiment, a predetermined symbol (e.g., RED 7) is displayed on the print layer P. A half mirror layer HM having a cut-out section 40 which is identical with or slightly smaller in geometry than the symbol of the print layer P, is superposed onto the entire surface of the print layer P such that the cut-out section 40 is superimposed on the print layer P. By such a configuration, when the white cold-cathode tube remains inactive, the player views the symbol through the cut-out section 40 of the half mirror layer HM. Hence, the predetermined symbol (RED 7) is perceived as it is. The neighborhood of the predetermined symbol (i.e., a background) is perceived as a silver color of the half mirror HM. When the white cold-cathode tube remains active, the light originating from the white cold-cathode tube reaches the player while passing through the background portion of the color-transparent print layer P other than the symbol and the half mirror layer HM. The player can perceive the light in the background color (e.g., white) provided by the print layer P. Since a cut-out section is formed in the area of the half mirror HM corresponding to the symbol. The player perceives the symbol in the form and color provided on the print layer at all times. As mentioned above, the half mirror layer HM in which the cut-out section 40 is formed on the print layer P so as to assume the same shape as that of the symbol of the print layer P is provided over the entirety of the print layer P. The color of the background of the symbol can be changed by activation/deactivation of the white cold-cathode tube.

Figure 9:
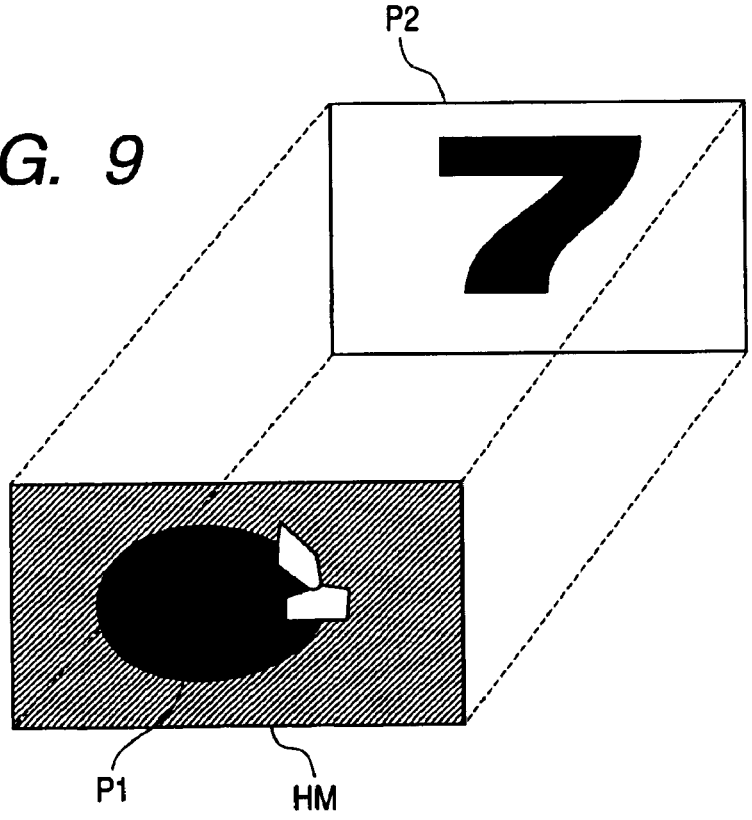
FIG. 9 is a schematic view showing the layered structure of a reel band according to a seventh embodiment of the invention.

FIG. 9 shows a seventh embodiment of the invention, a first symbol (e.g., RED 7) is displayed on the primary print layer P2. The entire surface of the primary print layer 2 is covered with the half mirror layer HM. A second symbol (e.g. PLUM) which is different from the first symbol is printed in slightly light color on the auxiliary print layer P1 provided on the half mirror layer HM. The player views the half mirror HM and the auxiliary print layer P1 provided thereon and perceives the second symbol (e.g., PLUM) against the silver background. When the white cold-cathode tube is activated, the light originating from the white cold-cathode tube reaches the player while passing through the color-transparent print layer P2, the half mirror layer HM, and portions of the auxiliary print layer P1. Hence, the player perceives the auxiliary print layer P1 (e.g., PLUM) superposed on the first symbol (e.g., RED 7) of the primary print layer P2 and the background (e.g., a blank) overlap each other. In this way, so long as the half mirror layer HM is provided over the entire upper surface of the primary print layer P2 and the auxiliary print layer P1 is provided on the upper surface of the half mirror layer HM, by activation/deactivation of the white cold-cathode tube, only the symbol displayed on the auxiliary print layer P1 can be displayed, or the symbol displayed on the primary print layer P2 and the symbol printed on the auxiliary print layer P1 can be displayed in an overlapping manner.

Figure 10:
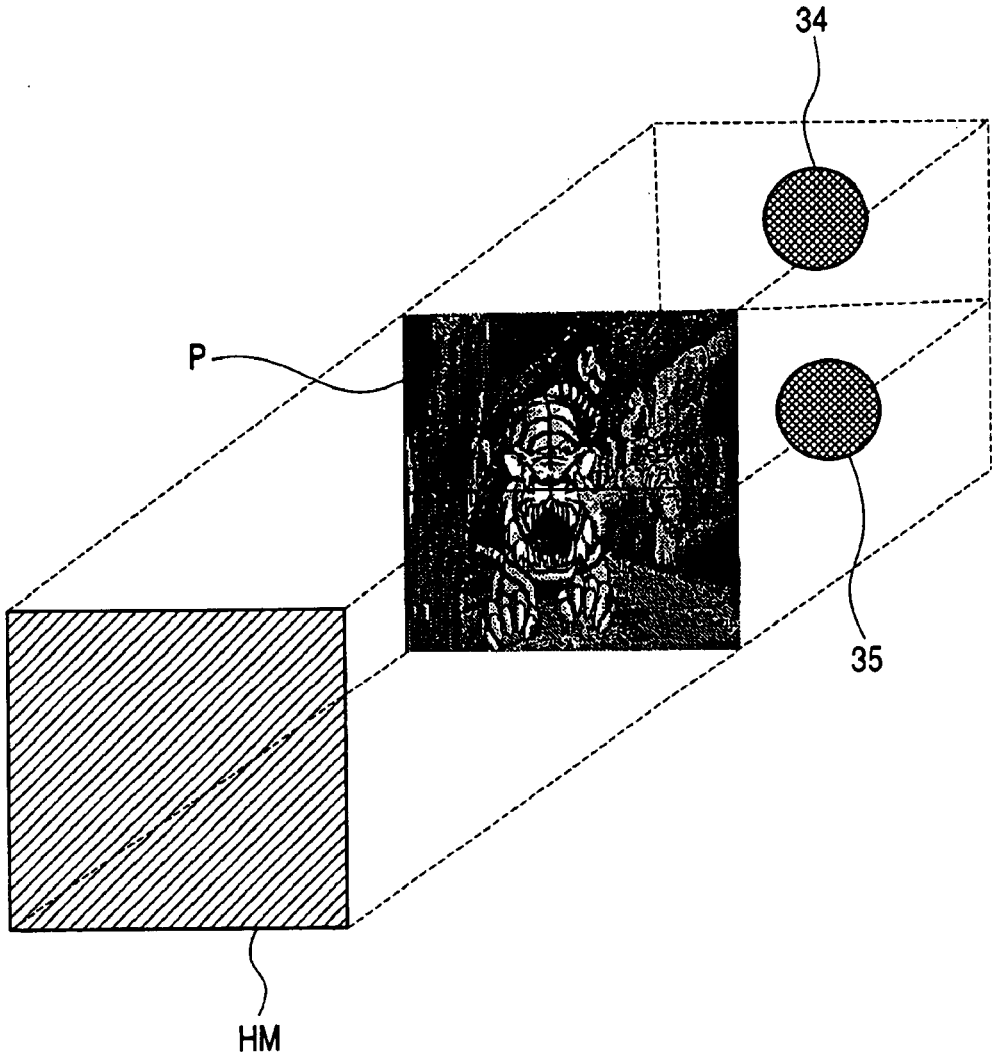
FIG. 10 is a schematic view showing the layered structure of a reel band according to an eighth embodiment of the invention.

FIG. 10 shows an eighth embodiment of the invention. In this embodiment, a presentation image is printed on the print layer P so as to extend across two shades 31, 32 (see FIG. 4) of the illuminator 30. The half mirror HM is provided over the entire upper surface of the print layer P. An unillustrated auxiliary print layer is also provided on the upper surface of the half mirror layer HM. All symbols required to cause the slot machine to proceed a game are displayed in this layer. The white cold-cathode tubes 34, 35 are usually held in an extinguished state. A game is caused to proceed by use of the symbols displayed on the auxiliary print layer. One or both the cold-cathode tubes 34, 35 is illuminated, as required. The player can perceive an upper half, a lower half, and an entire of the presentation image of the print layer P, as required. A predetermined presentation (e.g., reporting or notification of a predetermined item) is offered to the player in accordance with a progress in game, thereby realizing diversified game presentation. For example, when the player has stopped one or two reels by pressing any one or two of the stop buttons 7*a*, 7*b*, and 7*c*, the presentation image may be displayed on the thus-stopped reels, thereby reporting, e.g., the internally-selected winning combination to the player.

Figure 11:
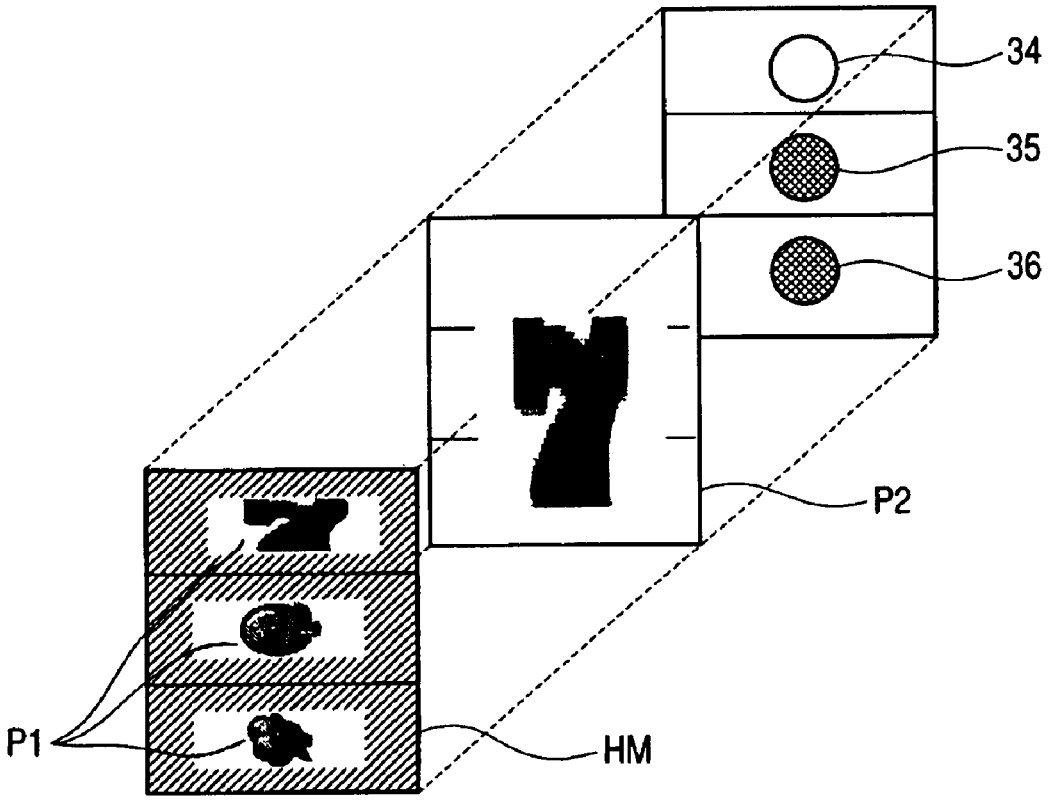
FIG. 11 is a schematic view showing the layered structure of a reel band according to a ninth embodiment of the invention.

FIG. 11 shows a ninth embodiment of the invention. In this embodiment, all the symbols required to cause the slot machine to proceed a game are displayed on an auxiliary print layer P1 provided on the upper surface of the half mirror layer HM. A symbol "RED 7" which is three times larger than normal "RED 7" is displayed at a position on a primary print layer P2 deviated by a predetermined distance from the position of "RED 7" on the auxiliary print layer P1. When a normal game proceeds, the white cold-cathode tubes 34, 35, and 36 remain extinguished. A game is caused to proceed by use of the symbols displayed on the auxiliary print layer P1. For example, when a big bonus win has arisen through the internal lottery, and the player can have stopped RED 7 along any one of the validated pay lines on the first reel R1 by actuation of the stop button 7*a*, the white cold-cathode tubes 35, 36 of the second and third reels R2, R3 are illuminated, thereby rendering the large RED 7 of the primary print layer P2 visible to the player. Since the large RED 7 is larger in size from the ordinary RED 7, the player can readily grasp the position of the RED 7 during the course of spinning operation. In addition, since the position of the large RED 7 precedes the position of the RED 7 on the auxiliary print layer P1 by a predetermined distance, a time lag from when the player has perceived the large RED 7 until when he/she presses the stop button can be assured. By the time lag, the player who is not good at performing the pinpoint stopping action can readily align the RED 7 of the auxiliary print layer P1 with the validated line by taking the large RED 7 as a hint, thus achieving a win.

A predetermined symbol to be used for constituting a winning combination can be changed by activation/deactivation of the white cold-cathode tubes during the course of progress in game. For example, when the tubes are switched between activation and deactivation at a moment at which the reel is to be stopped, the symbol per se is changed or the color of the symbol is changed, thereby changing a winning combination. Accordingly, a surprise in game can be provided to the player. The player will have a much greater interest in the game and enjoy the game.

A symbol differing from that used for constituting a winning combination during the course of progress in game or during an interval between games can be displayed, thereby offering an effect of presentation, such as that achieved through reporting operation. Further, the gaming machine can be constituted so as to provide auxiliary information supporting the pinpoint stopping action, such that a symbol displayed during spinning of the reel does not necessarily match the symbol appearing as a result of stoppage of the reel. Thus, there can be reduced the degree of a different in the number of tokens acquired between the player skilled in the pinpoint stopping action and players who are not good at the pinpoint stopping action.

Up to this point the invention has been described in connection with the embodiments which are considered to be most practical and preferable as of this point in time. However, the invention is not limited to the embodiments described herein. If necessary, the invention can be modified within a range in which the modifications are not contrary to the scope of the appended claims and the gist or idea of the invention which can be read from the entire specification. A gaming machine involving such modifications must be comprehended as falling within the technical scope of the invention.

What is claimed is:

1. A gaming machine, comprising:

at least one reel, to be rotated; and a reel belt, attached onto an outer circumferential face of the reel, the reel belt comprising:

a half mirror layer; and a first print layer, on which at least one first symbol is printed, placed behind the half mirror layer when viewed from a front face of the gaming machine.

2. The gaming machine as set forth in claim 1, wherein the half mirror layer is provided so as to overlap at least a part of the first symbol.

3. The gaming machine as set forth in claim 1, wherein the half mirror layer is laminated on the first print layer.

4. The gaming machine as set forth in claim 1, wherein the half mirror layer is laminated on a film layer having transparency with respect to visible light.

5. The gaming machine as set forth in claim 4, wherein the film layer is placed in front of the half mirror layer when viewed from the front face of the gaming machine.

6. The gaming machine as set forth in claim 1, further comprising a light source placed behind the reel belt when viewed from the front face of the gaming machine, for emitting visible light toward the front face of the gaming machine.

7. A gaming machine, comprising:

at least one reel, to be rotated; and a reel belt, attached onto an outer circumferential face of the reel, the reel belt comprising:

a half mirror layer; and a first print layer, on which at least one first symbol is printed, placed behind the half mirror layer when viewed from a front face of the gaming machine, wherein the reel belt further comprises a second print layer, on which at least one second symbol is printed, placed before the half mirror layer when viewed from the front face of the gaming machine.

8. The gaming machine as set forth in claim 7, wherein the second print layer includes a portion transparent with respect to visible light.

9. The gaming machine as set forth in claim 7, wherein the half mirror layer is provided so as to overlap at least a part of at least one of the first symbol and the second symbol.

10. The gaming machine as set forth in claim 7, wherein:

a plurality of first regions are arranged on the first print layer in a rotating direction of the reel such that the first symbol is printed in each of the first regions;

a plurality of second regions are arranged on the second print layer in the rotating direction of the reel such that the second symbol is printed in each of the second regions; and each of the first regions is associated with at least one of second regions.

* * * * *